US006863273B2

(12) United States Patent
Otto

(10) Patent No.: US 6,863,273 B2
(45) Date of Patent: Mar. 8, 2005

(54) DOCUMENT HANDLING APPARATUS WITH DYNAMIC INFEED MECHANISM AND RELATED METHOD

(75) Inventor: Edward M. Otto, Bethlehem, PA (US)

(73) Assignee: Bowe Bell & Howell Company, Durham, NC (US)

( * ) Notice: Subject to any disclaimer, the term of this patent is extended or adjusted under 35 U.S.C. 154(b) by 0 days.

(21) Appl. No.: 10/175,433

(22) Filed: Jun. 19, 2002

(65) Prior Publication Data

US 2003/0151192 A1 Aug. 14, 2003

Related U.S. Application Data

(60) Provisional application No. 60/356,229, filed on Feb. 12, 2002.

(51) Int. Cl.[7] ..... B65H 5/34

(52) U.S. Cl. ..... 271/270; 271/265.01; 271/258.01; 271/245

(58) Field of Search ..... 271/265.01, 258.01, 271/270, 10.03, 245, 246; 414/789.9, 790.7

(56) References Cited

U.S. PATENT DOCUMENTS

| | | | | | |
|---|---|---|---|---|---|
| 3,075,630 | A | | 1/1963 | Fisk | |
| 4,513,959 | A | * | 4/1985 | Kindt | 271/270 |
| 4,569,514 | A | * | 2/1986 | Holtje | 271/314 |
| 4,787,311 | A | * | 11/1988 | Mol | 101/232 |
| 4,974,828 | A | * | 12/1990 | Matsuo et al. | 271/293 |
| 5,018,716 | A | * | 5/1991 | Yoshida et al. | 271/227 |
| 5,050,859 | A | * | 9/1991 | Paxon | 271/270 |
| 5,119,146 | A | * | 6/1992 | Nobumori et al. | 399/396 |
| 5,147,092 | A | * | 9/1992 | Driscoll et al. | 271/184 |
| 5,178,379 | A | * | 1/1993 | Edwards et al. | 271/189 |
| 5,197,726 | A | * | 3/1993 | Nogami | 271/110 |
| 5,211,387 | A | * | 5/1993 | Lloyd et al. | 271/111 |
| 5,265,731 | A | * | 11/1993 | Van de Ven | 209/552 |
| 5,295,677 | A | * | 3/1994 | Hutner | 271/110 |
| 5,417,413 | A | * | 5/1995 | Huffman et al. | 271/225 |
| 5,602,571 | A | * | 2/1997 | Suda et al. | 346/134 |
| 5,634,635 | A | * | 6/1997 | Kobayashi et al. | 271/3.16 |
| 5,692,742 | A | * | 12/1997 | Tranquilla | 271/10.03 |
| 5,803,450 | A | * | 9/1998 | Brokate et al. | 271/270 |
| 5,851,009 | A | * | 12/1998 | Siebenmann | 271/270 |
| 5,924,686 | A | * | 7/1999 | Jacobson et al. | 271/3.17 |
| 5,954,330 | A | | 9/1999 | Rabindran et al. | |
| 6,062,556 | A | | 5/2000 | McCay | |
| 6,149,151 | A | * | 11/2000 | Blanchard et al. | 271/270 |
| 6,170,816 | B1 | * | 1/2001 | Gillmann et al. | 271/10.03 |
| 6,227,534 | B1 | * | 5/2001 | Schoedinger et al. | 271/114 |
| 6,237,912 | B1 | * | 5/2001 | Motooka et al. | 271/273 |
| 6,333,797 | B1 | * | 12/2001 | Katsuta et al. | 358/498 |
| 6,354,583 | B1 | * | 3/2002 | Skadow et al. | 271/10.03 |
| 6,378,859 | B1 | * | 4/2002 | Lubben et al. | 271/10.03 |
| 6,428,001 | B1 | * | 8/2002 | Jackson | 271/270 |
| 6,443,448 | B1 | * | 9/2002 | Mohr et al. | 271/270 |

FOREIGN PATENT DOCUMENTS

| | | | | |
|---|---|---|---|---|
| JP | 02249838 A | * | 10/1990 | B65H/7/18 |
| JP | 03102045 A | * | 4/1991 | B65H/5/02 |
| WO | WO 9212079 A1 | * | 7/1992 | B65G/47/31 |

* cited by examiner

*Primary Examiner*—Donald P. Walsh
*Assistant Examiner*—Matthew J. Kohner
(74) *Attorney, Agent, or Firm*—McDermott Will & Emery LLP

(57) ABSTRACT

A document handling apparatus for processing sheets comprises a dynamic in-feed device, a sheet receiving section disposed downstream from the dynamic in-feed device, and an electronic controller. The dynamic in-feed device comprises a sheet-driving device and a variable-speed motor operatively engaging the sheet-driving device. The dynamic in-feed device inputs a sheet according to a repeatable dynamic speed profile. The dynamic speed profile is defined by an initial input speed, a subsequent decelerating or accelerating speed curve, and a final input speed that is less than the initial input speed. The electronic controller communicates with the variable-speed motor for executing the dynamic speed profile and controlling the input device according to the dynamic speed profile.

43 Claims, 12 Drawing Sheets

DOCUMENT HANDLING APPARATUS WITH DYNAMIC INFEED MECHANISM AND RELATED METHOD

RELATED APPLICATIONS

This application claims the benefit of U.S. Provisional Patent Application Ser. No. 60/356,229, filed Feb. 12, 2002, the disclosure of which is incorporated herein by reference in its entirety.

TECHNICAL FIELD

The present invention is generally directed to the field of document handling and processing technology and, in particular, to improvements relating to the input or transport of material units.

BACKGROUND ART

Document handling operations typically involve transporting material units such as sheet articles along one for more flow paths, and through a number of different stations or modules. Each module performs a different operation on sheet articles. Examples include printing, turning, scanning, folding, staging, accumulating, envelope stuffing, binding, and the like. Because of the functions performed by such modules and the need for transporting sheet articles to and from the modules as well as through the physical structure of the modules, various types of physical contact with the sheet articles necessarily occur that could damage and/or smudge the sheet articles and/or cause the sheet articles to deviate from their intended paths. These interactions occur between the sheet articles and the components comprising the modules, and also between the sheet articles and the conveying devices employed to transport the sheet articles. Hence, proper control over the handling of sheet articles is a primary consideration when designing document processing equipment and subsequently operating such equipment. Problems attending the control over sheet articles can become exacerbated when the sheet articles are to be processed at different speeds among the various modules and even within the same module. For example, sheet articles often must be inputted into a given module at a speed matched with the speed of the preceding module, brought to an abrupt stop within the given module for the purposes of staging and/or accumulation, and then brought back up to a speed at which the sheet articles can be transferred to a succeeding module. Accordingly, there continues to be a widely recognized need for devices and methods for improving control over the transportation and handling of sheet articles in order to minimize damage, smudging and/or excessive skewing.

The present invention is provided to address, in whole or in part, these and other problems associated with prior art document handling technology.

DISCLOSURE OF THE INVENTION

The invention disclosed herein provides an apparatus and method for feeding sheets for feeding sheet into a receiving area according to a dynamic speed profile in order to improve control over the sheets as they are being fed. In one example of an advantageous dynamic speed profile, a sheet or sheets are fed at an initial speed and then decelerated or accelerated along a linear or non-linear curve as the feeding proceeds. The receiving area can be part of any suitable document-handling module, such as a staging or accumulation module. In a particularly advantageous implementation of the invention, the apparatus described herein for executing dynamic input control over the sheets is integrated with a module having a front stop mechanism for stopping and registering the lead edge of the sheet. In such implementation, the dynamic speed profile ensures that sheets are gradually and smoothly decelerated down to a lower value just before encountering the front stop mechanism. In this manner, damage to the leading edge of the sheet and excessive skewing of the sheet is prevented because an abrupt stopping event (and concomitant sudden deceleration) is avoided. Moveover, the implementation of dynamic infeeding facilitates the avoidance of conventional sheet-driving means such as O-rings or polycords known to be a primary cause of toner smudging. That is, the dynamic infeed mechanisms of the invention can be employed in connection with other document-handling components of the sheet-receiving module to be described below that are designed for minimum contact with the sheets and pressure thereon.

According to one embodiment, a document handling apparatus for processing sheets comprises a dynamic in-feed device, a sheet receiving section disposed downstream from the dynamic in-feed device, and an electronic controller. The dynamic in-feed device comprises a sheet-driving device and a variable-speed motor operatively engaging the sheet-driving device. The dynamic in-feed device inputs a sheet according to a repeatable dynamic speed profile. The dynamic speed profile is defined by an initial input speed, a subsequent varying speed curve, and a final input speed. Depending on whether the varying speed curve is an accelerating or decelerating speed curve, the final input speed will be greater than or less than the initial input speed. The electronic controller communicates with the variable-speed motor for executing the dynamic speed profile and controlling the input device according to the dynamic speed profile.

Preferably, the sheet-driving device comprises one or more pairs of input rollers. At least one of the input rollers is driven by the variable-speed motor.

According to another embodiment, an initializing device communicates with the electronic controller and is adapted to produce a signal to begin the dynamic speed profile. Preferably, the initializing device comprises a sheet-sensing device adapted to detect entry of a sheet into the sheet receiving section.

According to yet another embodiment, a front stop mechanism is disposed downstream from the dynamic in-feed device and electronically communicates with the electronic controller. Preferably, the front stop mechanism is movable into and out of the plane along which sheets generally travel through the sheet receiving section of the document handling apparatus. The front stop mechanism can comprise a front stop member and an actuator connected to the front stop member. The electronic controller communicates with the actuator in order to alternately activate and deactivate the actuator at appropriate times during operation of the document handling apparatus.

According to still another embodiment, a document handling apparatus comprises a sheet input device, a sheet receiving surface disposed downstream from the sheet input device, a front stop mechanism disposed downstream from the sheet input device, and an electronic controller communicating with the sheet input device. The sheet input device comprises a first input roller and a second input roller. The first and second input rollers define a sheet feed plane therebetween. The front stop mechanism comprises a front stop member and an actuator connected to the front stop member. The front stop member is movable by the actuator into and out of the sheet feed plane. The electronic controller operates the sheet input device according to a repeatable dynamic speed profile. The dynamic speed profile is defined by an initial input speed, a subsequent varying speed curve, and a final input speed.

A method is also provided for inputting sheets into a sheet handling apparatus, according to the following steps. A sheet is fed at an initial input speed to a dynamic in-feed device. The dynamic in-feed device comprises a sheet-driving device and a variable-speed motor operatively engaging the sheet-driving device. The operational speed of the sheet-driving device is controlled by controlling the operational speed of the variable-speed motor according to a repeatable dynamic speed profile. The dynamic speed profile is defined by the initial input speed, a subsequent varying speed curve, and a final input speed. The sheet-driving device engages the sheet and drives the sheet into a sheet receiving section of the sheet handling apparatus according to the dynamic speed profile. Accordingly, the sheet is driven at the initial input speed, and the initial input speed is changed according to the varying speed curve until the final input speed is reached and the sheet has reached a final position in the sheet receiving section. The presence of the sheet in the final position is detected, such as by using an electronic sensing device. Upon detection of the sheet in the final position, one or more additional sheets can be processed by the sheet handling apparatus according to the above steps.

Preferably, the operational speed of the variable-speed motor is controlled by transmitting an appropriate electronic signal to the motor from an electronic controller that is provided to execute instructions adapted to carry out the dynamic speed profile. In addition, an electronic sensing device or similarly functioning component detects the presence of the sheet in the final position and sends a detection signal to the electronic controller as part of the step of controlling the operational speed of the variable-speed motor.

The method can also comprise the step of stopping the sheet at the final position by moving a front stop mechanism into the path of the sheet in the sheet receiving section. Each sheet inputted into the sheet receiving section that reaches the final position therein can be counted. After a designated number of sheets have reached the final position, the front stop mechanism can be caused to move out from the path of the sheets to enable the sheets to be transported from the sheet handling apparatus to a downstream location.

According to another method, a sheet is inputted into a document handling apparatus by carrying out the following steps. A leading edge of the sheet is received at an initial speed. The sheet, including its leading edge, is initially fed into the document handling apparatus at a first input speed substantially equal to the initial speed. The sheet, including a portion of the sheet following the leading edge, continues to be fed into the document handling apparatus according to a varying speed curve. The feeding of the sheet, including a trailing edge of the sheet, into the document handling apparatus is completed at a final input speed. The final input speed is less or greater than the initial input speed.

It is therefore an object to provide a document handling apparatus for inputting sheet articles into a sheet receiving area in a controlled manner, such that the risk of sheet damage and/or misfeed is reduced or eliminated, and particularly such an apparatus for use in high-speed media processing.

It is another object to provide a document handling apparatus that inputs sheets according to a dynamic speed profile.

It is yet another object to provide a document handling apparatus for improved handling of processed sheet articles that eliminates or at least greatly minimizes toner smudging of smearing of the sheet articles.

Some of the objects having been stated hereinabove and which are achieved in whole or in part by this invention, other objects will become evident as the description proceeds when taken in connection with the accompanying drawings as best described hereinbelow.

DETAILED DESCRIPTION OF THE INVENTION

Figure 1:
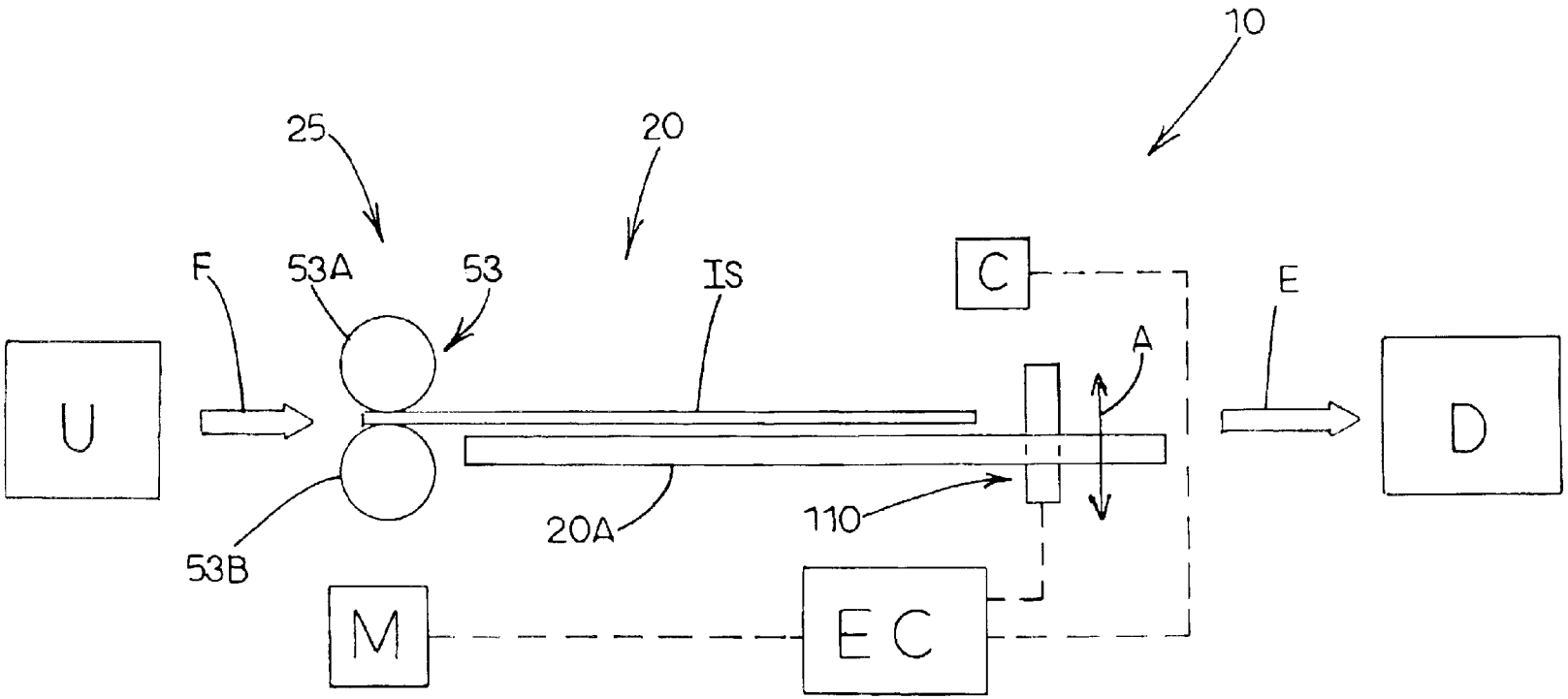
FIG. 1 is a schematic view of a document handling apparatus provided in accordance with the present invention.

Referring now to FIG. 1, a document handling apparatus, generally designated 10, is illustrated according to the present invention. Document handling apparatus 10 is adapted to feed material units such as incoming sheets IS generally along a material feed path or input direction F from an upstream location into a sheet receiving section, generally designated 20. From sheet receiving section 20, incoming sheet IS (or an accumulated stack of inputted sheets) can then be transferred to a downstream location generally along an exit path or output direction E. Exit path E can be the same or different from feed path F, depending on the design and function of document handling apparatus 10. As a general matter, "sheets" can constitute any form of material units capable of being processed by document handling equipment. Sheet receiving section 20 generally comprises a sheet receiving surface 20A, and can be provided as a part of any number of sheet receiving assemblies utilized in document processing operations. Non-limiting examples of sheet receiving assemblies include accumulating, collecting, collating, staging, and transport devices. In the present embodiment, the upstream location can comprise an upstream sheet processing device or module U and the downstream location can comprise a downstream sheet processing device or module D. Non-limiting examples of upstream modules U include feeders, cutters, readers, folders, stagers, and turnover devices. Non-limiting examples of downstream modules D include readers, stagers, turnover devices, folders, inserters, diverters, envelope stuffers, postage meters, and finishers (e.g., stitchers, binders, shrink wrappers, or the like).

Document handling apparatus 10 is adapted to feed incoming sheets IS into sheet receiving section 20 in a controlled manner so as to prevent damage to, skewing of, and/or smudging of incoming sheets IS and, if needed, to improve synchronization of the document in-feed process with other document handling processes occurring before, during or after the document in-feed process. The dynamically controlled in-feed of sheets is implemented by providing means for feeding each incoming sheet IS in accordance with a repeatable (i.e., cyclical) dynamic speed profile. This dynamic speed profile is characterized by an initial input speed that is followed by a period of varying speed, which in turn terminates at a final input speed that is either greater or less than the initial input speed. The period of varying speed constitutes a ramping down and/or ramping up of the speed as each incoming sheet IS is driven into sheet receiving section 20. A downward ramp of the input speed constitutes a period of deceleration, which can be a constant or non-linear rate of deceleration. Deceleration progresses until the final input speed is reached at the end of the cycle, with the final input speed being lower than the initial input speed. An upward ramp of the input speed constitutes a period of constant or non-linear acceleration, in which case the final input speed is greater than the initial input speed. Preferably, in either case, the initial input speed is matched with the output speed of upstream module U to provide a smooth operational transition from upstream module U to document handling apparatus 10. If necessary, sheet output means (not specifically shown in FIG. 1) can be provided for subsequently adjusting the speed of each incoming sheet IS (or an accumulating stack of sheets) to an output speed that matches the input speed of downstream module D, as described hereinbelow in connection with an exemplary accumulating apparatus.

According to the present embodiment, the means for dynamically controlling the in-feed of incoming sheets IS comprises a dynamic infeed device, generally designated 23. Dynamic infeed device 23 is a variable-speed input device that includes a sheet-driving mechanism, generally designated 53, and a variable-speed motor M. Preferably, sheet-driving mechanism 53 comprises one or more pairs of dynamic in-feed rollers 53A and 53B between which incoming sheets IS are driven into sheet receiving section 20. At least one of dynamic in-feed rollers 53A and 53B is operatively connected by conventional means to variable-speed motor M, so that rotation of variable-speed motor M according to the dynamic speed profile causes dynamic in-feed rollers 53A and 53B to rotate according to the same or a proportionally scaled (i.e., due to any intervening transmission components such as a shaft and/or gearing) dynamic speed profile. Variable-speed motor M is in turn controlled by an appropriately programmed electronic controller EC or microcontroller such as a microprocessor or other suitable means for executing instructions that establish and/or define the dynamic speed profile.

Preferably, electronic controller EC is programmable to enable the dynamic speed profile to be modified and thus rendered suitable with the particular document handling job (and the particular sequence of operations characterizing such job) of which the dynamic infeeding process is a part. Non-limiting examples of variables that could be factored into the programming of electronic controller EC include sheet size, the output speed of a module responsible for supplying sheets to dynamic infeed device 23, the distance between dynamic infeed device 23 and any front stop mechanism provided (e.g., front stop mechanism 110 illustrated in FIG. 1 and described hereinbelow) or other component with which sheets interact, the period of time to be allotted for the dynamic infeeding to occur, and the requirement of synchronization between the dynamic infeeding process and other document handling operations associated with the particular job.

As known in the art, a microcontroller such as electronic controller EC typically includes a programmable central processing unit and associated memories, such as a random access memory (RAM) or other dynamic storage device for data and read-only memory (ROM) and/or electrically erasable read-only memory (EEPROM) for program storage. In accordance with the embodiments herein, the microcode stored in the memory includes the programming for implementation of the variable speed motor control in accordance with the profile, response to sheet infeed detection, the control of front stop mechanism 110, and the like. For example, a part of the microcode program defines the profile or references separately stored data defining the profile. The microcontroller can be a microprocessor, a digital signal processor or other programmable device, implemented either as a general purpose device or as an application-specific integrated (ASIC) chip.

With continuing reference to FIG. 1, a conventionally designed electronic sensing or counting device C, such as a photoelectric detector, can be placed in communication with electronic controller EC and suitably mounted within sheet receiving section 20 so as to detect or count each incoming sheet IS as that sheet IS travels a predetermined distance into sheet receiving section 20. Once sensing or counting device C detects the presence of a particular incoming sheet IS (e.g., the leading edge of incoming sheet IS) at the designated final position within sheet receiving section 20, counting device C sends an appropriate initializing signal or electronic flag to electronic controller EC. The initializing signal received by electronic controller EC enables electronic controller EC to determine the proper time to start or restart the in-feed cycle characterized by the dynamic speed profile, thereby prompting document handling apparatus 10 to prepare for a new incoming sheet IS to be driven by sheet-driving mechanism 53 into sheet receiving section 20.

Dynamic infeed device 23 is well suited for operation in connection with one or more other sheet processing components that require accurate operational synchronization in relation to a repeating process cycle. Thus, according to at least one embodiment of the invention, document handling apparatus 10 further comprises a movable front stop mechanism, generally designated 110, that is adapted to operate in conjunction with dynamic infeed device 23. Front stop mechanism 110 provides a downstream boundary for sheet receiving section 20, and enables sheets to be staged, collected, or accumulated in sheet receiving section 20 if desired. As an example, in each sheet feed cycle, the leading edge of incoming sheet IS encounters front stop mechanism 110 and is stopped thereby. Front stop mechanism 110 can also be employed to register the front edge of each incoming sheet IS as a sheet stack develops, thus assisting in squaring up the sheet stack prior to advancing the sheet stack to a downstream site (e.g., downstream module D). For this purpose, front stop mechanism 110 preferably is movable into the path of incoming sheet IS as shown in FIG. 1 when sheet accumulation and/or staging is desired, such as by extending through an opening in sheet receiving surface 20A. Once a predetermined number of sheets have been collected, and/or once a sheet or sheets have been staged for a predetermined period of time, front stop mechanism 110 can be retracted out of the sheet path to enable the sheet of stack of sheets to be transported further downstream. The movement of front stop mechanism 110 is depicted by an arrow A in FIG. 1.

In order to coordinate the operation of front stop mechanism 110 with that of dynamic infeed device 23, it is also preferable that front stop mechanism 110 electronically communicate with and thus be controlled by electronic controller EC. Accordingly, electronic controller EC can be programmed to receive the feedback signals generated by counting device C, determine when a predetermined number of sheets have accumulated, and then send (or remove, as appropriate) a control signal to front stop mechanism 110, whereupon front stop mechanism 110 retracts to permit the accumulated stack of sheets to be transported further downstream. A detailed description of a specific, exemplary embodiment of front stop mechanism 110 is provided hereinbelow.

Figure 2:
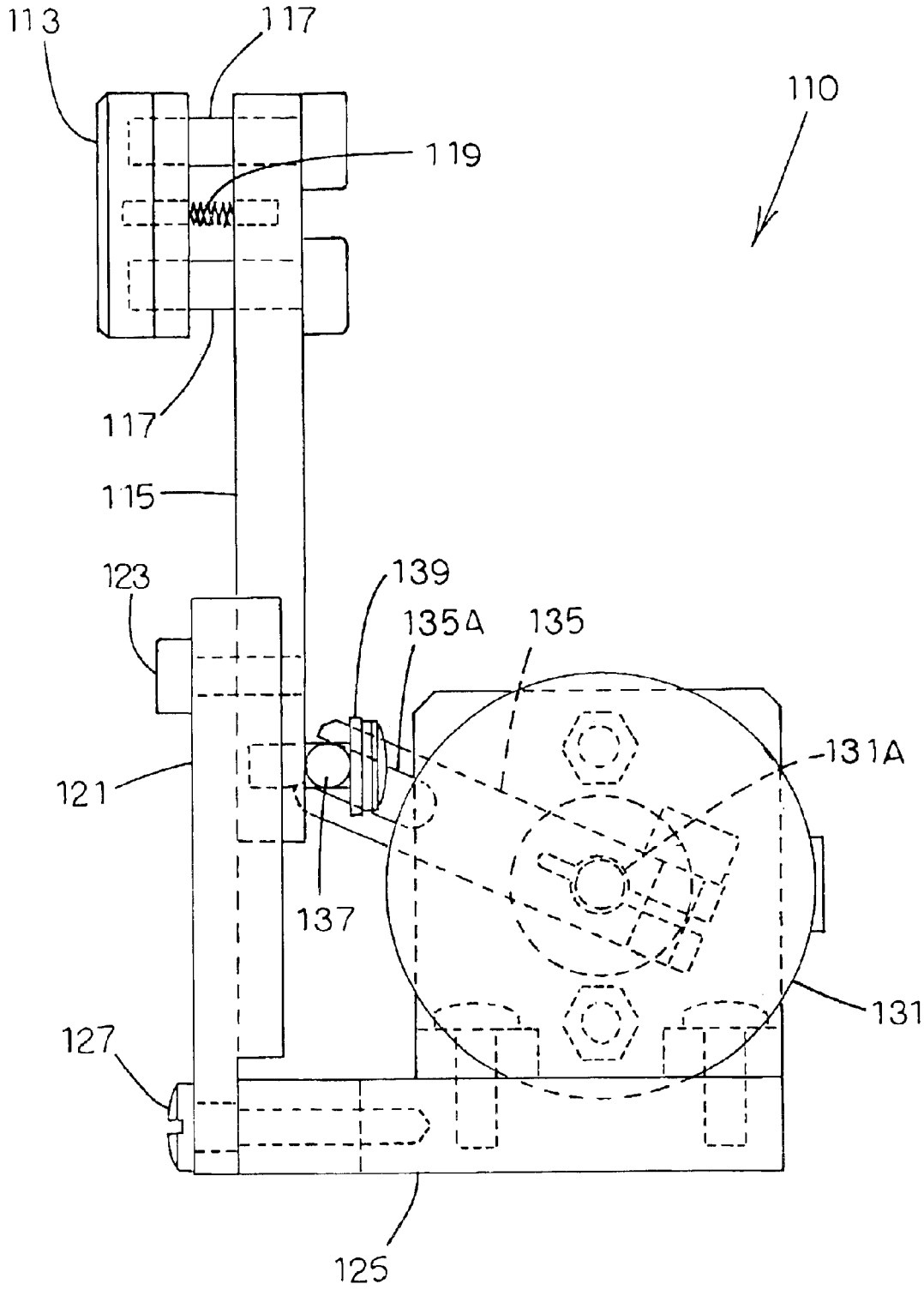
FIG. 2 is a side elevation view in partial phantom of a front stop mechanism used in conjunction with certain embodiments of the present invention.

Referring to FIG. 2, further details of one embodiment of front stop mechanism 110 are shown. One or more front stop fingers or plates 113 are connected to a vertical slide plate 115 using shoulder bolts 117 or other suitable securing means. If desired, a compression spring 119 is interposed between each front stop finger 113 and vertical slide plate 115 to enable each front stop finger 113 to recoil to a degree sufficient to jog sheets entering into sheet receiving section 20 (FIG. 1), thereby registering the sheets along their respective lead edges. Preferably, compression springs 119 are generally axially aligned with a central sheet feed plane P (see, e.g., FIG. 9) when front stop fingers 113 are extended. Vertical slide plate 115 is connected to a guide plate 121 through one or more guide members 123. Guide plate 121 is mounted to a support plate 125 by means of one or more suitable fasteners such as bolts 127. Guide members 123 are movable within respective slots formed through guide plate 121 to enable vertical slide plate 115 to slide vertically with respect to guide plate 121. The interaction of vertical slide plate 115 with guide plate 121 thus enables front stop fingers 113 to move into and out of the material feed path as described hereinabove.

A powered drive source adapted for reversible rotary power transfer, such as a rotary solenoid or reversible motor 131, is mounted to support plate 125 through a suitable mounting bracket 133 and includes an output shaft 131A. An actuating arm 135 having a U-slot 135A is connected to output shaft 131A, such that rotation of output shaft 131A clockwise or counterclockwise rotates actuating arm 135 in a like manner. Actuating arm 135 is linked to vertical slide plate 115 by means of a transverse pin 137. Transverse pin 137 is secured to vertical slide plate 115 through one or more suitable fasteners such as bolts 139. Transverse pin 137 is situated within U-slot 135A of actuating arm 135, and thus is movable along the length of U-slot 135A. Accordingly, rotation of actuating arm 135 in one direction imparts an upward force to transverse pin 137 and results in vertical slide plate 115 sliding upwardly, while rotation of actuating arm 135 in the other direction imparts a downward force to transverse pin 137 and results in vertical slide plate 115 sliding downwardly.

It will be understood that the invention is not limited to providing a movable front stop mechanism 110. In other embodiments of the invention, the structure employed for stopping and/or registering the lead edge of sheets can be fixed with respect to sheet receiving surface 20A (see, for example, right-angle staging apparatus 200 illustrated in FIG. 8 and described hereinbelow).

From the foregoing description, it can be seen that the incorporation of dynamic infeed device 23 into document handling apparatus 10 is particularly advantageous when it is desired to process one or more sheets in a controlled, cyclical manner without damage and/or skewing prior to further processing by, for example, downstream module D. Examples of specific applications of the invention will now be described with reference to FIGS. 3–10.

Referring now to FIGS. 3–7, document handling apparatus 10 is provided in the form of an accumulating device, generally designated 100. Accumulating apparatus 100 is adapted to accumulate material without smudging or otherwise marring any printed matter contained on either side of the sheet material being processed. In some embodiments, accumulating apparatus 100 is selectively adjustable between an over-accumulating mode of operation and an under-accumulating mode of operation. In general, accumulating apparatus 100 comprises an input section, generally designated 15; an accumulation area (sheet receiving section) 20; and an output section, generally designated 25. Arrow F in FIG. 2 indicates the general direction of material flow through accumulating apparatus 100. As understood by persons skilled in the art, the various components comprising input section 15, accumulation area 20, and output section 25 are disposed in relation to a framework assembly of accumulating apparatus 100. The framework assembly can comprise a number of various structural members as appropriate for assembling accumulating apparatus 100 into an integrated unit. It will be further understood that accumulating apparatus 100 can be situated in-line between upstream modules U and downstream modules D (see FIG. 1) as part of a larger material processing system.

Input section 15 of accumulating apparatus 100 controls the speed of the incoming sheets according to the dynamic speed profile described hereinabove as the sheets are being fed into accumulation area 20. Thus, input section preferably includes dynamic in-feed rollers 53A and 53B (see FIG. 4) associated with dynamic infeed device 23 of FIG. 1. Once a sheet enters accumulation area 20, that sheet is held while other sheets are permitted to enter accumulation area 20 either under or over the first sheet. If accumulating apparatus 100 is set to over-accumulate sheets in accumulation area 20, the first sheet entering accumulation area 20 becomes the bottom-most sheet in the resulting stack of accumulated sheets. If, on the other hand, accumulating apparatus 10 is set to under-accumulate sheets, the first sheet becomes the top-most sheet in the resulting stack of accumulated sheets. Once a predetermined number of sheets have accumulated in accumulation area 20, such as by employing conventional sensing or counting means (e.g., counting device C in FIG. 1), a transport mechanism (described hereinbelow) generally situated within accumulation area 20 advances the stack into output section 25, from which the sheet set is transported from accumulating apparatus 100 to the downstream site.

Figure 3:
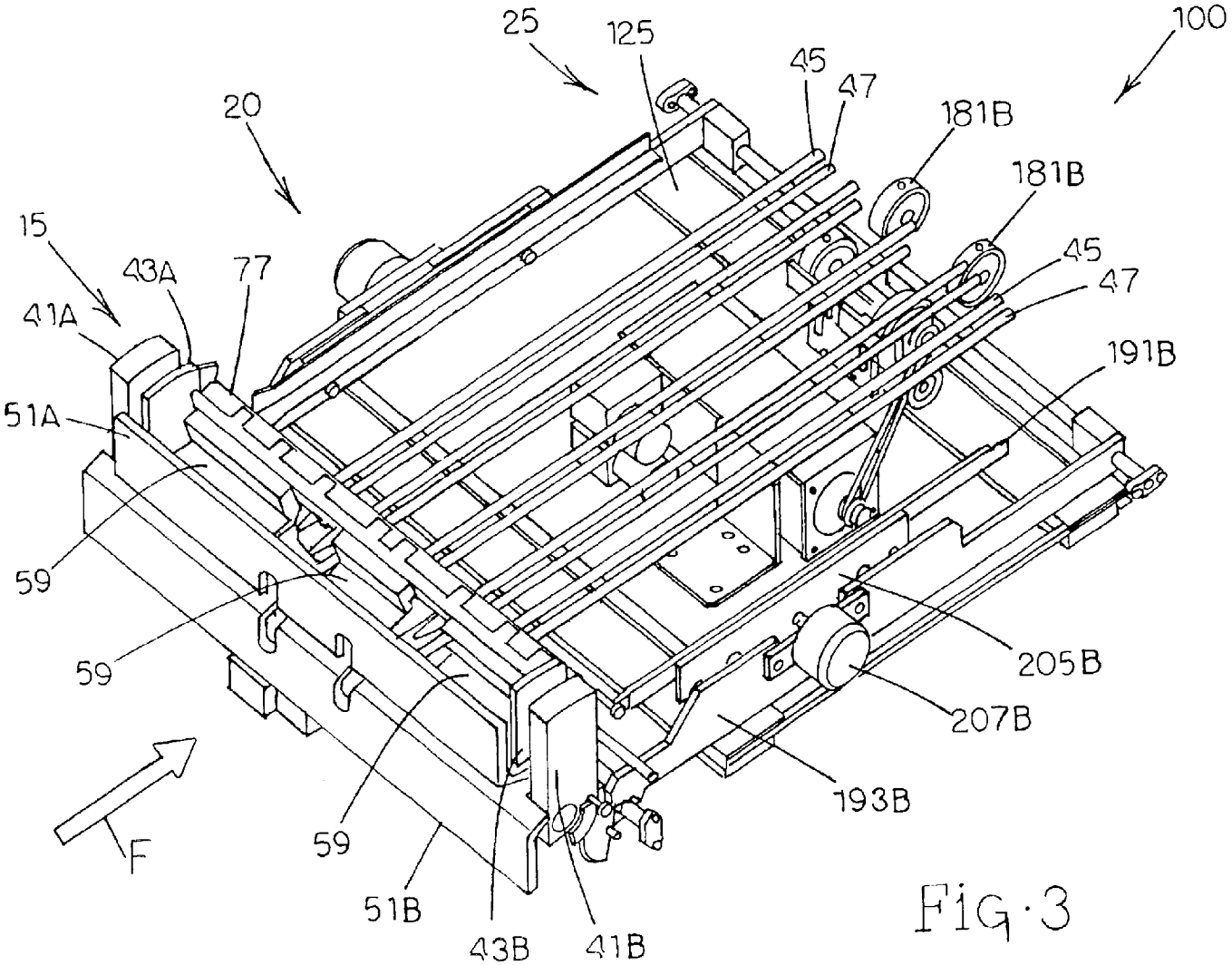
FIG. 3 is a perspective view of a document handling apparatus provided in the form of an accumulating apparatus.

As shown in FIG. 3, a set of top support (or sheet guide) rods 45 and a set of bottom support (or sheet guide) rods 47 extend through accumulation area 20, and respectively define upper and lower structural boundaries for the set of material units accumulating in accumulation area 20. Bottom support rods 47 can serve as sheet receiving surface 20A illustrated in FIG. 1. Preferably, two or more corresponding pairs of top support rods 45 and bottom support rods 47 are provided, with each pair being laterally spaced from adjacent pairs. Top and bottom support rods 45 and 47 are passive elements. As such, top and bottom support rods 45 and 47 do not impart active forces to the sheets, and thus do not smudge the sheets. In furtherance of the smudge-free operation of accumulating apparatus 100, it is also preferable that top and bottom support rods 45 and 47 be cylindrical so as to present the smallest possible contact area for the sheets.

Figure 4:
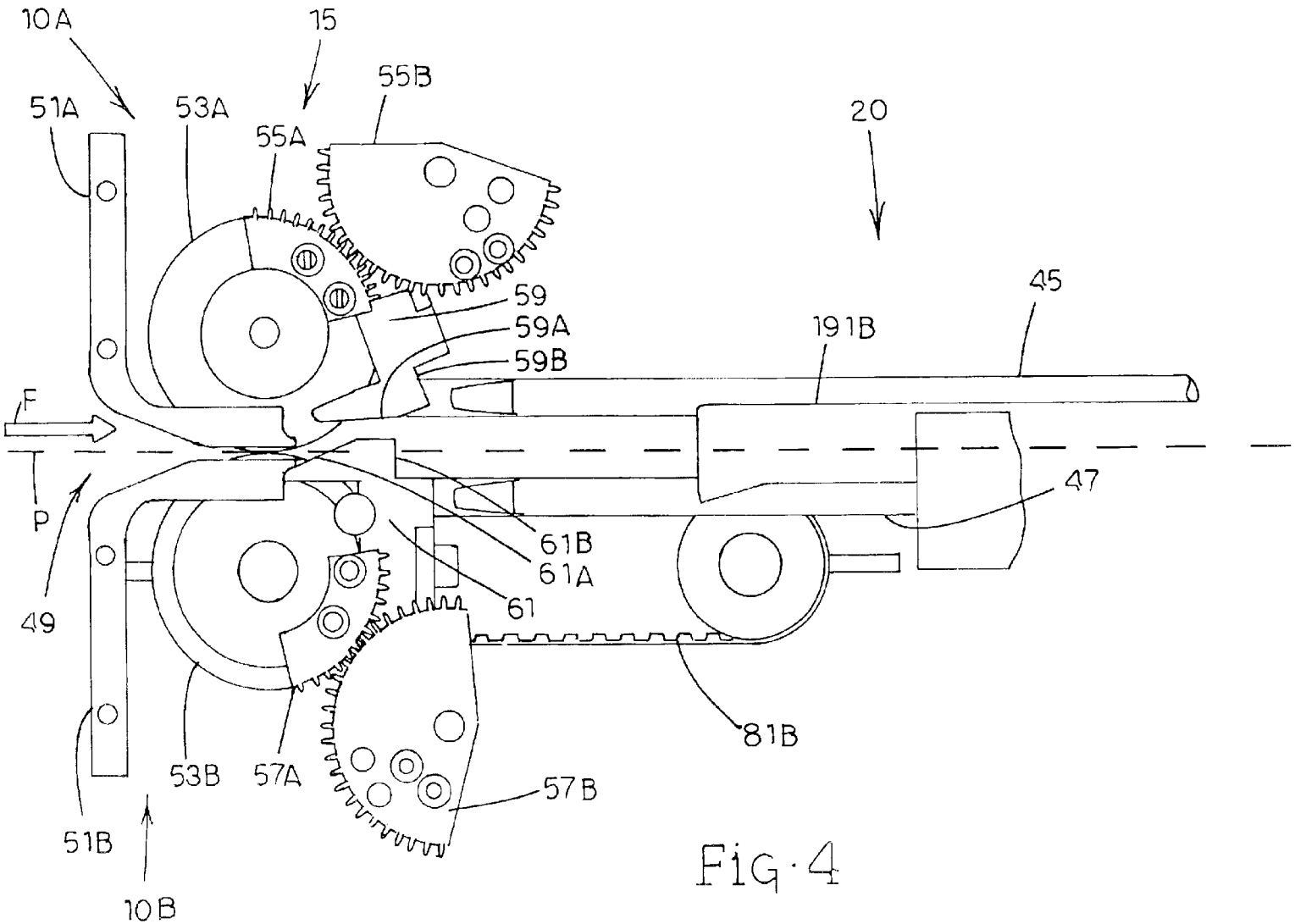
FIG. 4 is a side elevation view of an upstream region of the accumulating apparatus illustrated in FIG. 3.

Referring to FIG. 4, the material flow path indicated by arrow F through accumulating apparatus 100 is directed generally along a central sheet feed plane P. Central sheet feed plane P thus also indicates the general flow path of sheets through accumulating apparatus 100, and further provides a general demarcation between upper and lower sections of accumulating apparatus 100. In FIG. 4, upper section is generally designated 10A and lower section is generally designated 10B. Input section 15 of accumulating apparatus 100 comprises an entrance area, generally designated 49, defined at least in part by a top entrance guide 51A disposed in upper section 10A of accumulating apparatus 100 above central sheet feed plane P and a bottom entrance guide 51B disposed in lower section 10B below central sheet feed plane P.

As described hereinabove, input section 15 further comprises dynamic in-feed mechanism 23 shown in FIG. 1, and thus preferably includes the pair of dynamic in-feed rollers 53A and 53B. Top in-feed roller 53A is disposed in upper section 10A of accumulating apparatus 10 above central sheet feed plane P, and bottom in-feed roller 53B is disposed in lower section 10B below central sheet feed plane P. Hence, a nip is formed between top and bottom in-feed rollers 53A and 53B that is generally situated about central sheet feed plane P. As described hereinabove, the coupling of one of in-feed rollers 53A or 53B to variable-speed motor M (see FIG. 1) renders the rollers "dynamic" in the sense that their rotational speed is variable over a given range (for example, approximately 80 ips to approximately 180 ips, where "ips" denotes "inches per second"). For each cycle, defined for the present purpose as a sheet being fed through input section 15 and into accumulation area 20 (and accumulating over or under the pre-existing stack, if any), the dynamic speed profile is characterized by an initial input speed (preferably matched with output speed of the upstream module U) followed by a ramping down of the speed as the sheet enters accumulation area 20 and abuts front stop mechanism 110 (see, e.g., FIG. 2). The ramp of deceleration that forms a part of the dynamic speed profile can be associated with a constant rate of deceleration or a non-linear rate. As one example, the initial in-feed speed can be 180 ips, which is thereafter dynamically slowed down according to a predetermined speed profile to a final speed of 80 ips.

In the exemplary embodiment shown in FIG. 4, input section 15 also comprises a switchable over/under accumulating mechanism that comprises the following components. First and second top gears or gear segments 55A and 55B, respectively, are mounted in upper section 10A of accumulating apparatus 100 above central sheet feed plane P, and rotate about respective parallel axes in meshing engagement with each other. Similarly, first and second bottom gears or gear segments 57A and 57B, respectively, are mounted in lower section 10B of accumulating apparatus 100 below central sheet feed plane P, and rotate about respective parallel axes in meshing engagement with each other. Thus, first and second top gear segments 55A and 55B rotate in opposite senses with respect to each other, and first and second bottom gear segments 57A and 57B rotate in opposite senses with respect to each other. In a preferred embodiment, first top gear 55A and top in-feed roller 53A rotate about the same axis, and first bottom gear 57A and bottom in-feed roller 53B rotate about the same axis.

The over/under accumulating mechanism further comprises one or more top accumulation ramps 59 and one or more bottom accumulation ramps 61. Top accumulation ramps 59 are linked in mechanical relation to first top gear segment 55A and rotate therewith, and bottom accumulation ramps 61 are linked in mechanical relation to first bottom gear segment 57A and rotate therewith. As shown in FIG. 4, top and bottom accumulation ramps 59 and 61 preferably include respective inclined surfaces 59A and 61A and back-stop surfaces 59B and 61B. One or more top hold-down spring fingers 63 (see FIG. 7) are linked in mechanical relation to second top gear segment 55B and rotate therewith, and one or more bottom top hold-down spring fingers 65 (see FIG. 7) are linked in mechanical relation to second bottom gear segment 57B and rotate therewith. Inclined surfaces 59A and 61A of respective top and bottom accumulation ramps 59 and 61, and top and bottom hold-down fingers 63 and 65, selectively interact with incoming sheets as described hereinbelow. The selectivity depends on whether the over-accumulation mode or under-accumulation mode is active. As also described hereinbelow, respective back-stop surfaces 59B and 61B of top and bottom accumulation ramps 59 and 61 assist in selectively registering the trailing edge of the stack of sheets.

Referring back to FIG. 4, the intermeshing of first and second top gear segments 55A and 55B operatively couples top accumulation ramps 59 and top hold-down fingers 63 together. Similarly, the intermeshing of first and second bottom gear segments 57A and 57B operatively couples bottom accumulation ramps 61 and bottom hold-down fingers 65 together. Inner thumb knobs 43A and 43B (see FIG. 3) mechanically communicate with first top gear segments 55A and second top gear segments 55B so as to effect adjustment of the relative positions of top accumulation ramps 59 and top hold-down fingers 63. Similarly, outer thumb knobs 41A and 41B (see FIG. 3) mechanically communicate with first bottom gear segments 57A and second bottom gear segments 57B so as to effect adjustment of the relative positions of bottom accumulation ramps 61 and bottom hold-down fingers 65.

Figure 7:
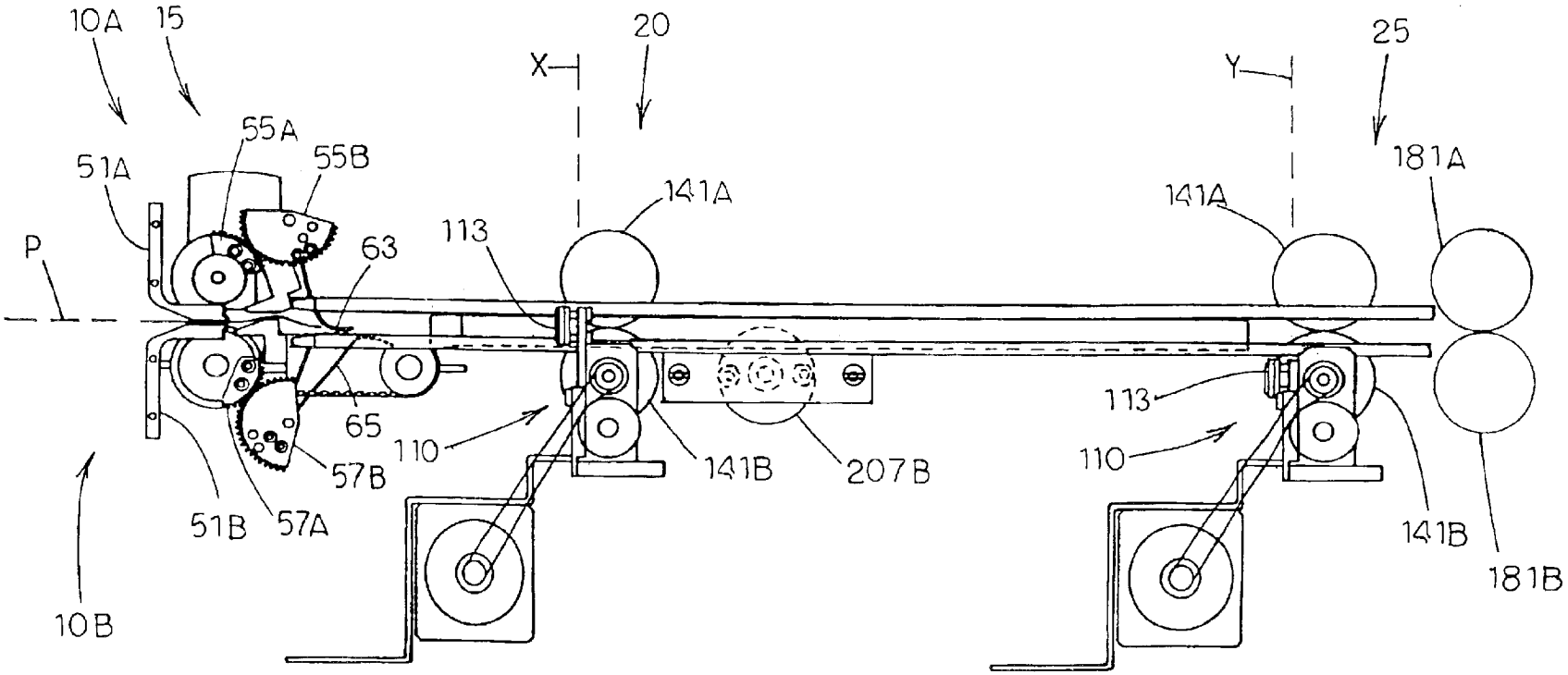
FIG. 7 is a side elevation view of the accumulating apparatus illustrated in FIG. 3.

FIGS. 4 and 7 depict accumulating apparatus 100 in its over-accumulating mode. Inner thumb knobs 43A and 43B (see FIG. 3) are pivoted to cause the coupling interaction of first and second top gear segments 55A and 55B, top accumulation ramps 59 and top hold-down fingers 63. Outer thumb knobs 41A and 41B (see FIG. 3) are pivoted to cause the coupling interaction of first and second bottom gear segments 57A and 57B, bottom accumulation ramps 61 and bottom hold-down fingers 65. As a result, and as shown in FIGS. 4 and 7, top accumulation ramps 59 are disposed in a raised position out of the material flow path while, at the same time, top hold-down fingers 63 are disposed in a lowered position in the material flow path. Also at the same time, bottom accumulation ramps 61 are disposed in a raised position in the material flow path while bottom hold-down fingers 65 are disposed in a lowered position out of the material flow path. This configuration results in an over-accumulation of sheets in accumulation area 20.

Accumulating apparatus 100 can be converted to the under-accumulating mode by pivoting inner thumb knobs 43A and 43B and outer thumb knobs 41A and 41B to new positions. At the new positions, top accumulation ramps 59 would be disposed in a lowered position in the material flow path, while top hold-down fingers 63 would be disposed in a raised position out of the material flow path. At the same time, bottom accumulation ramps 61 would be disposed in a lowered position out of the material flow path, while bottom hold-down fingers 65 would be disposed in a raised position in the. material flow path. This configuration results in an under-accumulation of sheets in accumulation area 20.

Figure 5:
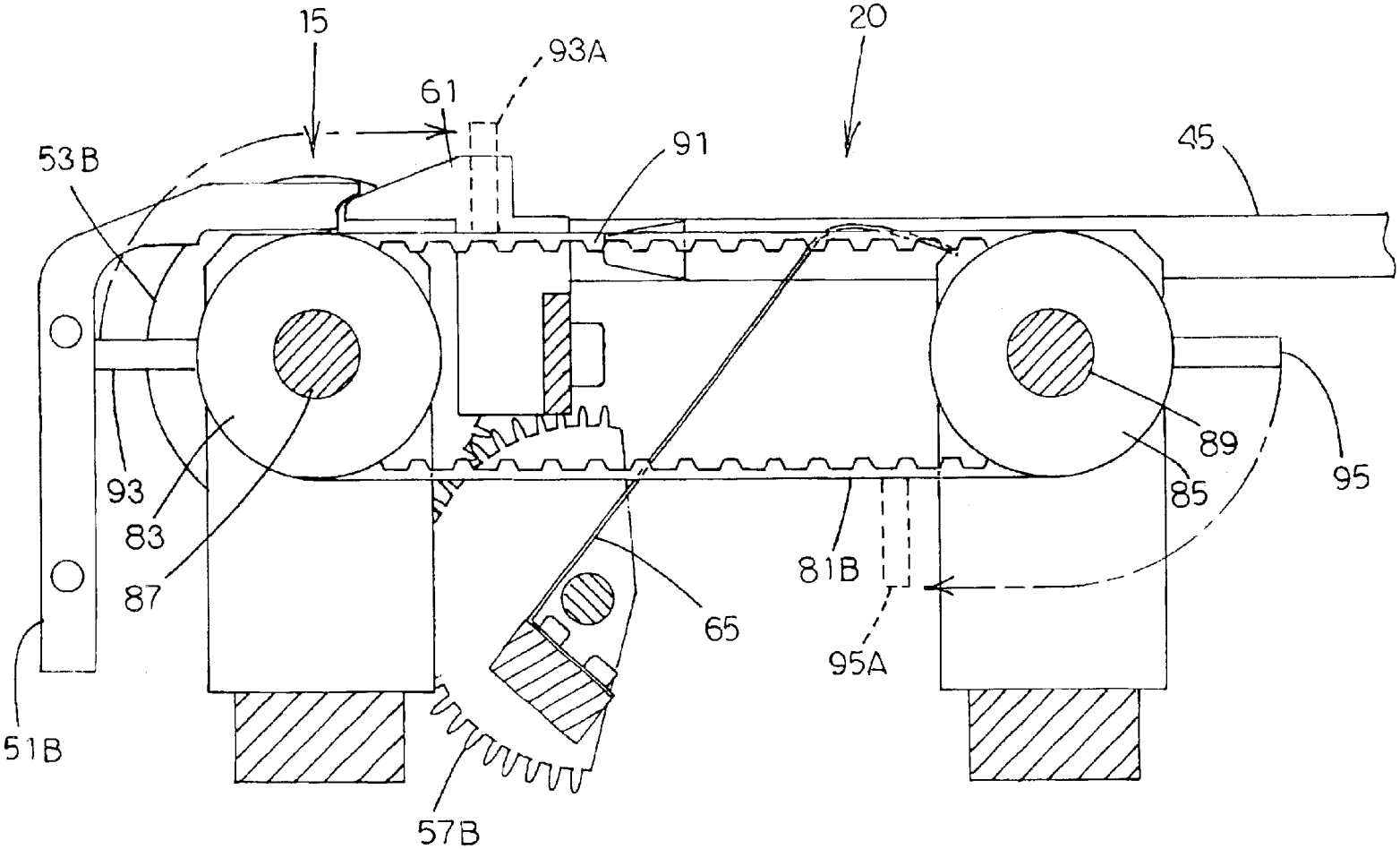
FIG. 5 is a side elevation view of a portion of the accumulating apparatus illustrated in FIG. 3, showing details of a transport device provided therewith.
Figure 6:
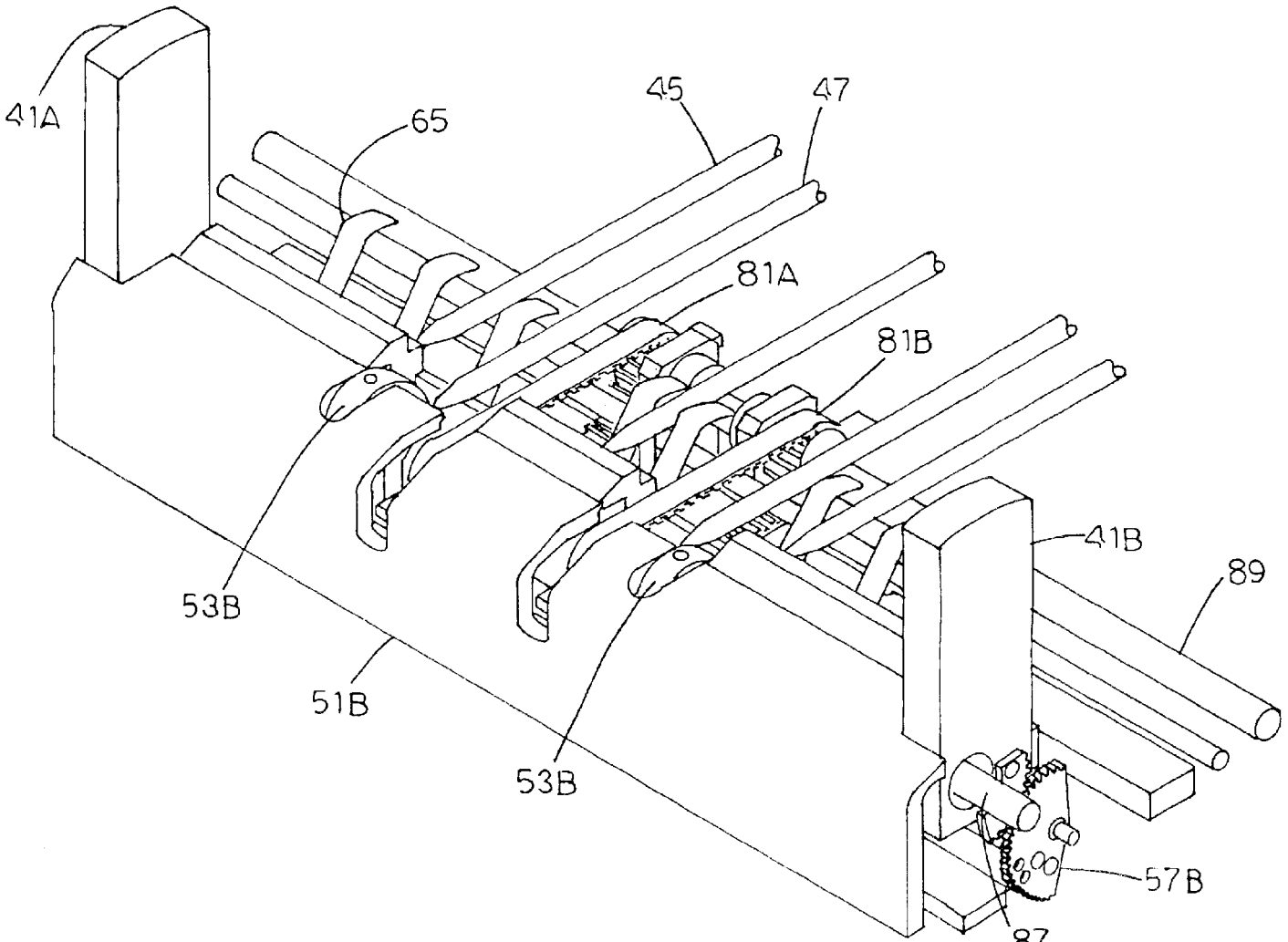
FIG. 6 is a perspective view of an upstream region of the accumulating apparatus illustrated in FIG. 3.

Referring now to FIGS. 5 and 6, one or more dual-lugged transport belts 81A and 81B are disposed at the interfacial region of input section 15 and accumulation area 20 of accumulating apparatus 100. Transport belts 81A and 81B rotate about rotatable elements such as pulleys 83 and 85 mounted to shafts 87 and 89, with one of shafts 87 and 89 being driven by a suitable motor (not shown). In a preferred embodiment, upstream-side pulleys 83 rotate about the same axis as lower infeed rollers 53B, and thus upstream-side shaft 87 can be a common axle engaged by both upstream-side pulleys 83 and lower infeed rollers 53B. The inner surface of each transport belt 81A and 81B includes a plurality of inside lugs 91 that engage ribbed pulleys 83 and 85 in order to positively drive transport belts 81A and 81B. The outside surface of each transport belt 81A and 81B, likewise includes outside lugs 93 and 95 of suitable design (see FIG. 5) for engaging the trailing edge of a sheet or sheets. Suitable designs of such outside lugs 93 and 95 are known in the art. In one exemplary embodiment, each transport belt 81A and 81B includes two outside lugs 93 and 95 cyclically spaced 180 degrees apart from each other, with each outside lug 93 and 95 of one transport belt 81A being situated in phase with each corresponding outside lug 93 of the other transport belt 81B. The upper run of each transport belt 81A and 81B is disposed at a high enough elevation within accumulation area 20 so as to enable outside lugs 93 to contact the trailing edge of the sheet stack residing in accumulation area 20, thereby permitting transport belts 81A and 81B to advance the sheet stack through accumulation area 20 along the material flow path. In FIG. 5, the positions of lugs 93 and 95 are designated 93A and 95A, respectively, at the moment before lug 93A contacts a sheet stack.

Referring to FIG. 7, front stop mechanism 110, such as described hereinabove with reference to FIGS. 1 and 2, is disposed generally within accumulation area 20. The longitudinal position of front stop mechanism 110 with respect to input section 15 can be made adjustable in order to accommodate different lengths of sheets. In FIG. 7, for example, front stop mechanism 110 is shown disposed at a position X at which sheets of a relatively short length (e.g., 3.50 inches) can be accommodated, and is also alternatively shown disposed at a position Y at which sheets of a relatively long length (e.g., 14.0 inches) can be accommodated. Front stop fingers 113 are alternately extended across central sheet feed plane P (and thus in the material flow path) or retracted below central sheet feed plane P (and thus out of the material flow path). In FIG. 7, for purposes of illustration, front stop fingers 113 are shown in the extended position at position X of front stop mechanism 110 and in the retracted position at position Y of front stop mechanism 110. It will be understood, however, that front stop fingers 113 are alternately extendable and retractable during the operation of accumulating apparatus 100 at all positions of front stop mechanism 110 available along the length of accumulation area 20. As described hereinabove, in addition to adjusting the position of front stop mechanism 110, electronic controller EC (see FIG. 1) can be reprogrammed if necessary to modify the dynamic speed profile to accommodate different sizes of sheets.

As also shown in FIG. 7, in the present accumulator embodiment, one or more pairs of output rollers 141A and 141B can be associated with front stop mechanism 110. Top output roller 141A is disposed in upper section 10A of accumulating apparatus 100 above central sheet feed plane P, and bottom output roller 141B is disposed in lower section 10B below central sheet feed plane P. Hence, a nip is formed between top and bottom output rollers 141A and 141B that is generally situated about central sheet feed plane P. In the case where a downstream material processing device operates in connection with accumulating apparatus 100, the rotational speed of output rollers 141A and 141B is preferably matched to the speed of the downstream device, which ordinarily is a constant speed falling within the approximate range of, for example, 80 ips to 180 ips. Output rollers 141A and 141B are disposed at a fixed distance downstream from front stop fingers 113, yet are longitudinally adjustable with front stop fingers 113 along the length of accumulation area 20 to accommodate different sizes of sheets.

With continuing reference to FIG. 7, output section 25 of accumulating apparatus 100 further comprises one or more pairs of exit rollers 181A and 181B. For each pair of exit rollers 181A and 181B provided, top exit roller 181A is disposed in upper section 10A of accumulating apparatus 100 above central sheet feed plane P, and bottom exit roller 181B is disposed in lower section 10B below central sheet feed plane P (in FIG. 3, only bottom exit rollers 181B are shown for clarity). Exit rollers 181A and 181B form a nip that is generally situated about central sheet feed plane P. The speed of exit rollers 181A and 181B is matched to that of output rollers 141A and 141B and thus to that of the downstream device.

Electronic controller EC (see FIG. 1) can be placed in communication not only with variable speed motor M driving dynamic infeed rollers 53A and 53B, but also with movable or energizable components such as the motor driving transport belts 81A and 81B, the actuator 131 driving front stop fingers 113, the motor 161 driving output rollers 141A and 141B, and the motor driving exit rollers 181A and 181B. Electronic controller EC can thus maintain synchronization of these various components of accumulating apparatus 100, as well as control the respective operations of specific components. It will be further understood that electronic controller EC can receive feedback from upstream and downstream modules U and D in order to determine the proper speeds of the various rollers, and can receive feedback from various sensors (such as counter C) situated in accumulating apparatus 100 to determine the location of sheets or to count the number of sheets accumulating in accumulation area 20. Thus, in the present accumulator embodiment, electronic controller EC determines the dynamic speed profile of dynamic infeed rollers 53A and 53B, as described hereinabove, in order to feed sheets at an initial input speed and slow the sheets down to a reduced speed as the sheets approach front stop fingers 113. In addition, electronic controller EC determines when the proper number of sheets have accumulated, after which time electronic controller EC causes front stop fingers 113 to retract out of the material flow path, transport belts 81A and 81B to move the stack forward into output rollers 141A and 141B, output rollers 141A and 141B to move the stack to exit rollers 181A and 181B, and the exit rollers 181A and 181B to move the stack toward an area or device downstream from accumulating apparatus 100. The provision of independent input, transport, and output drives enables accumulating apparatus 100 to be matched with any upstream and downstream devices.

The operation of accumulating apparatus 100 as described hereinabove will now be summarized with reference being made generally to FIGS. 3–7. As an incoming sheet IS enters accumulating apparatus 100 under the control of an upstream device, incoming sheet IS passes through top and bottom entrance guides 51A and 51B into the nip formed by top and bottom in-feed rollers 53A and 53B. Incoming sheet IS thus enters accumulation area 20 under the control of dynamic in-feed rollers 53A and 53B. At this point, the rotational speed of dynamic in-feed rollers 53A and 53B is preferably matched to the output speed of the upstream device. Preferably, this matched speed is at or near the maximum speed of dynamic in-feed rollers 53A and 53B, and thus corresponds to the maximum flow rate of incoming sheets IS into input section 15 of accumulating apparatus 100. Dynamic in-feed rollers 53A and 53B advance incoming sheet IS into accumulating apparatus 100 for a predetermined distance, at the top speed that is preferably matched to the output speed of the upstream material processing device. The speed of in-feed rollers 53A and 53B is then dynamically reduced to slow down the flow rate of incoming sheet IS, thereby allowing the lead edge of incoming sheet IS to contact spring-loaded front stop mechanism 110 without the risk of damage.

The recoiling reaction of front stop mechanism 110, if provided, induces a jogging action that registers incoming sheet IS with the rest of sheet stack S between front stop mechanism 110 and either top accumulation ramp 59 or bottom accumulation ramp 61 (depending on whether accumulating apparatus 10 is set for under-accumulation or over-accumulation as described hereinabove). The speed of dynamic in-feed rollers 53A and 53B is increased back up to top velocity to advance subsequent incoming sheets IS into accumulation area 20, and the slowdown process again occurs such that the dynamic speed profile is implemented for each cycle of incoming sheets IS being fed into accumulating apparatus 100. Each incoming sheet IS can be fed completely individually, in subsets, or in overlapping relation to other incoming sheets IS.

When a complete set of sheets (sheet stack S) has been over- or under-accumulated, the following exit routine transpires. Spring loaded front stop fingers 113 retract out of the sheet feed path. Means (not shown) can be provided if desired to jog or otherwise register the sheets from side-to-side. At this time, the sheets can be held in position for a predetermined time of the exit routine prior to further downstream advancement of the sheet set. Dual-lugged transport belts 81A and 81B then start to cycle. In one example, one cycle equals 180 degrees at a fixed speed of approximately 30 ips. The low speed of dual-lugged transport belts 81A and 81B minimizes trail-edge damage when outside lugs contact 93 (see FIG. 5) and advance the set of accumulated sheets. As dual-lugged transport belts 81A and 81B cycle, they contact the trail edge of the set of accumulated sheets and advance the lead edge of the accumulated set into the pair of output rollers 141A and 141B. As described hereinabove, output rollers 141A and 141B are positioned at a fixed distance downstream from front stop fingers 113, and their speed is preferably matched with that of the downstream device, which ordinarily will be a fixed, constant speed ranging between, e.g., approximately 80 ips to approximately 180 ips. As the lead edge of sheet stack S enters output rollers 141A and 141B, output rollers 141A and 141B advance sheet stack S at a higher rate of speed than dual-lugged transport belts 81A and 81B. As sheet stack S advances in this manner, its lead edge enters the pair of fixed-position exit rollers 181A and 181B, the speed of which is preferably matched with the speed of output rollers 141A and 141B and that of the downstream device. Once the trail edge of this sheet stack S has passed by spring-loaded front stop fingers 113, front stop fingers 113 extend back into the sheet path ready for the next set of sheets to accumulate.

Figure 8:
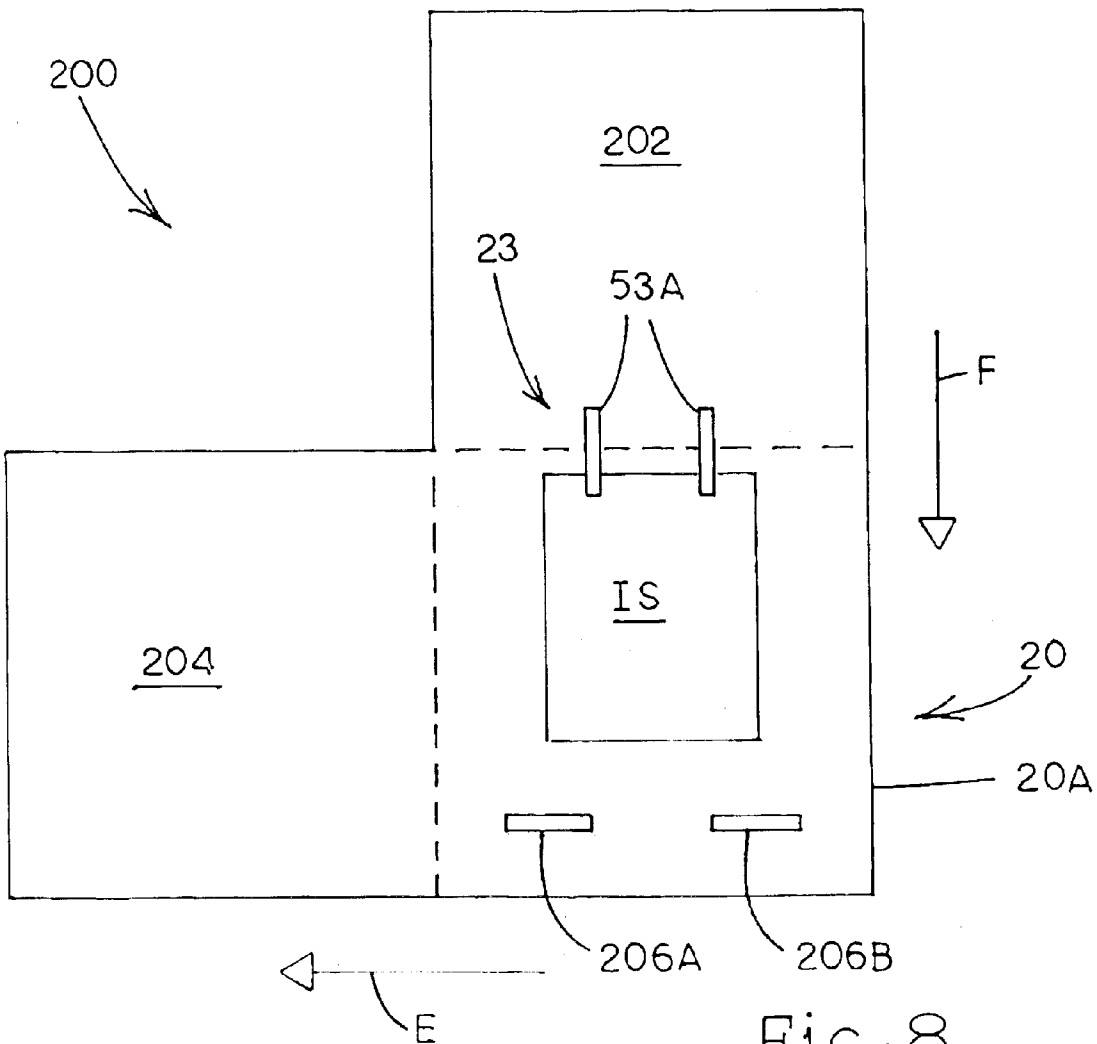
FIG. 8 is a schematic view of a document handling apparatus provided in the form of a right-angle staging apparatus.

Referring now to FIG. 8, document handling apparatus 10 (FIG. 1) is provided in the form of a right-angle staging apparatus, generally designated 200, or other type of staging apparatus commonly employed to stage one or more sheets in between other document handling tasks. Right-angle staging apparatus 200 is particularly useful for both staging sheets as well as turning the direction of flow of such sheets from feed path F to exit path E. Staging apparatus 200 generally comprises an input area 202, a staging area 20 serving as the sheet receiving section, and an output area 204. Input area 202 could form a part of an upstream device (e.g., upstream module U illustrated in FIG. 1) or could be a separate component that receives incoming sheets IS from the upstream device. Output area 204 could form a part of a downstream device (e.g., downstream module D illustrated in FIG. 1) or could be a separate component from which sheets are advanced to the downstream device after being staged in staging area 20 for a desired amount of time.

Staging area 20 includes a sheet receiving or staging surface 20A on which incoming sheets IS can be staged for a predetermined amount of time. One or more sheet-stopping surfaces 206A and 206B are disposed on or near staging surface 20A to stop and/or register the lead edge of incoming sheets IS as they enter staging area 20 from input area 202. Dynamic infeed device 23 is disposed at or near the interface of input area 202 and staging area 20 to control the input of incoming sheets IS into staging area 20. For this purpose, dynamic infeed device 23 can be constructed as described hereinabove with reference to FIG. 1, with a sheet-driving mechanism 53 comprising one or more pairs of rollers (only upper dynamic in-feed rollers 53A are shown). In particular, dynamic infeed device 23 in this embodiment operates to slow incoming sheets IS down prior to contacting sheet-stopping surfaces 206A and 206B to prevent damage and/or skewing of incoming sheets IS.

Figure 9A:
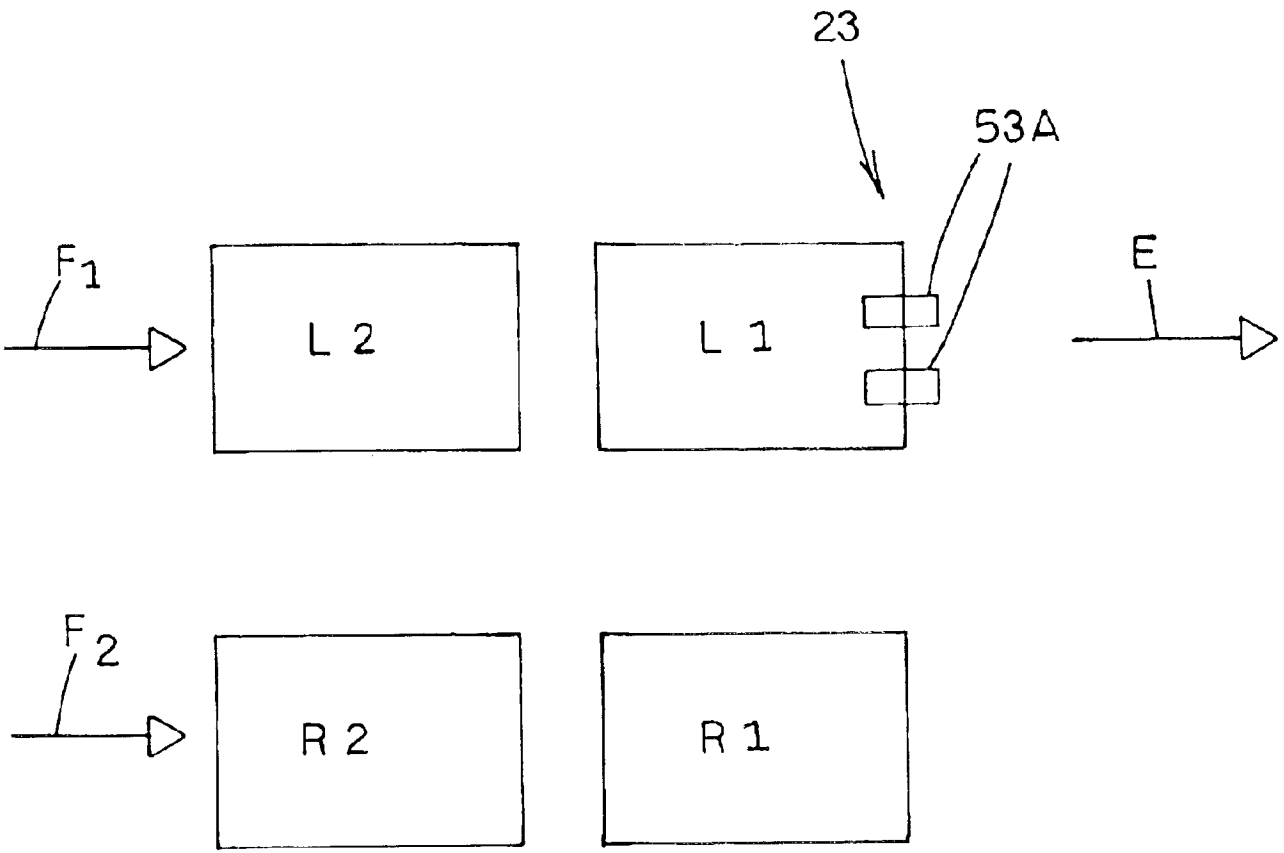
FIGS. 9A–9C are sequential schematic views illustrating a sheet merging process enabled by the present invention.
Figure 9B:
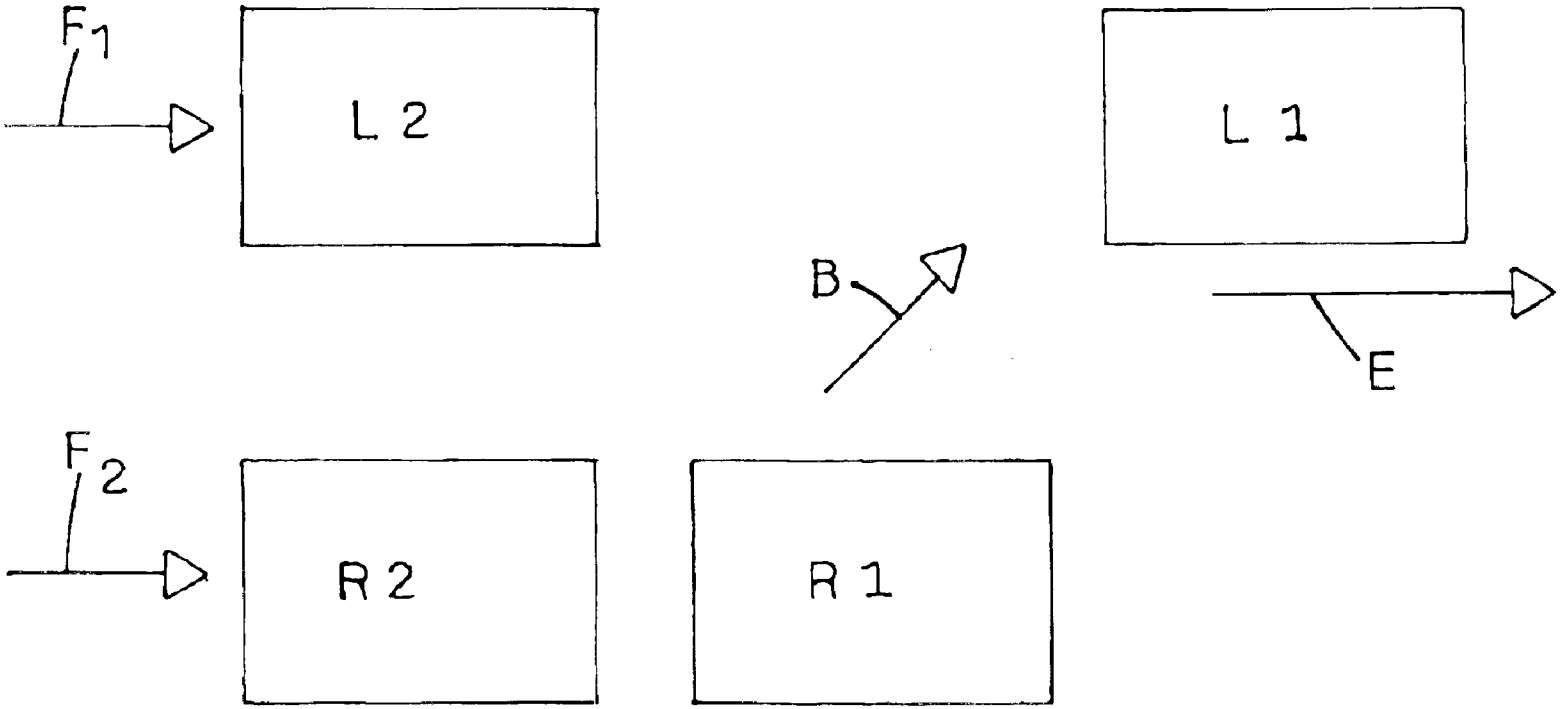
Figure 9C:
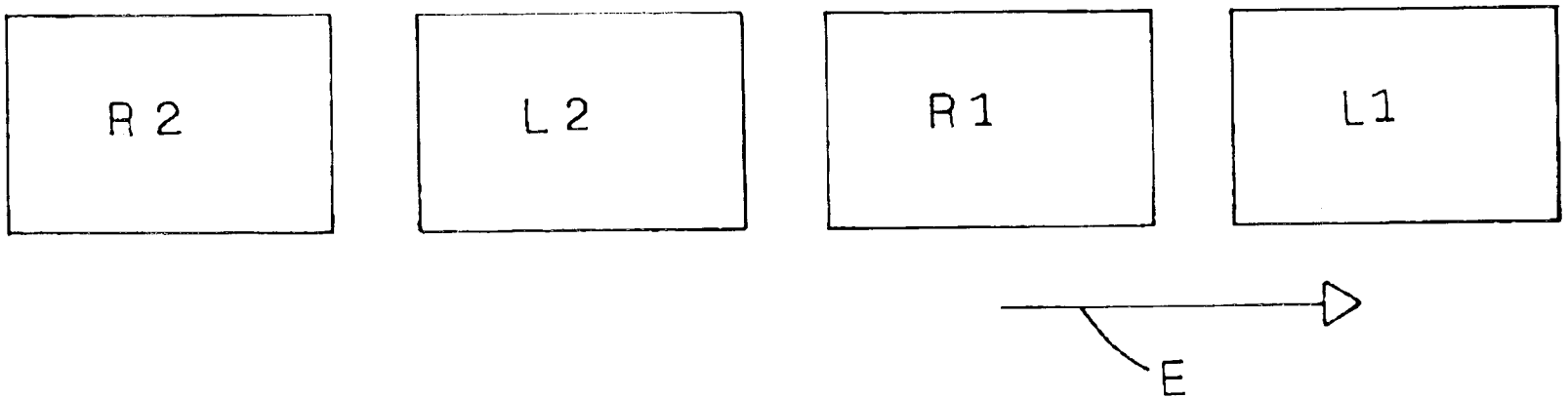

Referring now to FIGS. 9A–9C, a method is illustrated by which dynamic infeed device 23 can be employed for the purpose of merging two initially separate input sheet streams into a single continuous output sheet stream. As known in the art, a long web of two-up material containing two adjacent rows or series of printed matter can be initially provided as a continuous roll or fan-folded stack. The continuous web is fed to a slitting device to slit the web lengthwise along the center axis of the web to separate the two rows of printed matter, and also to cut a cross-cutting device to cut the web cross-wise at equal intervals to form individual uniformly-sized sheets. These cutting and slitting operations result in two sheet streams, in which the first sheet stream contains sheets $L_1$, $L_2$, . . . $L_i$ and the second sheet stream contains sheets $R_1$, $R_2$, . . . $R_i$. It is often desired to merge these two sheet streams into a single output stream in prior to inputting the sheets into downstream modules such as accumulators, collectors and folders, which ordinarily are not capable of handling a double-wide, side-by-side arrangement of sheets.

As shown in FIG. 9A, the two sheet streams can be fed along two separate feed paths $F_1$ and $F_2$, which do not need to be parallel and can differ in elevation from each other if necessary. Initially, the two sheet streams can flow at the same speed or different respective speeds. At least one dynamic infeed device 23 is provided, preferably with rollers 53A as described hereinabove. Dynamic in-feed device 23 is situated along the path of at least one of the two sheet streams, such as the first sheet stream containing sheets $L_1$, $L_2$, . . . $L_i$ as illustrated in FIG. 9A. Dynamic infeed device 23 engages sheet $L_1$ and drives sheet $L_1$ according to a dynamic speed profile. The dynamic speed profile programmed into electronic controller EC (see FIG. 1) causes dynamic infeed device 23 to accelerate sheet $L_1$ to a greater speed than that of the following sheets $L_2$ . . . $L_i$ of the first sheet stream and all of the sheets $R_1$, $R_2$, . . . $R_i$ of the second sheet stream. Referring to FIG. 9B, the acceleration is sufficient to increase the gap between the trail edge of sheet $L_1$ and the lead edge of sheet $L_2$ to a length at least slightly greater than the length of sheet $R_1$. Conventional diverting means (not shown) are provided to cause sheet $R_1$ to move into the increased gap between sheet $L_1$ and sheet $L_2$, as indicated by arrow B. The dynamic speed profile executed by dynamic infeed device 23 is repeated for each sheet in the series of at least one of the sheet streams (in the present example, sheets $L_1$, $L_2$, . . . $L_i$). As a result, and as illustrated in FIG. 9C, a single output sheet stream of merged sheets $L_1$, $R_1$, $L_2$, $R_2$, . . . , $L_i$, $R_i$ flows along an exit path E to an intended downstream location.

It will be understood in this embodiment that exit path E of the merged output stream can be in-line with the first sheet stream as illustrated, wherein the sheets $R_1$, $R_2$, . . . $R_i$ of the second sheet stream are merged with the sheets $L_1$, $L_2$, . . . $L_i$ of the first sheet stream. Alternatively, the sheets $L_1$, $L_2$, . . . $L_i$ of the first sheet stream could be merged into the sheets $R_1$, $R_2$, . . . $R_i$ of the second sheet stream. In addition, regardless of which sheet stream contains dynamic infeed device 23, each sheet stream could be diverted such that the resulting merged output sheet stream is off-line in relation to both the first and the second sheet streams.

Figure 10:
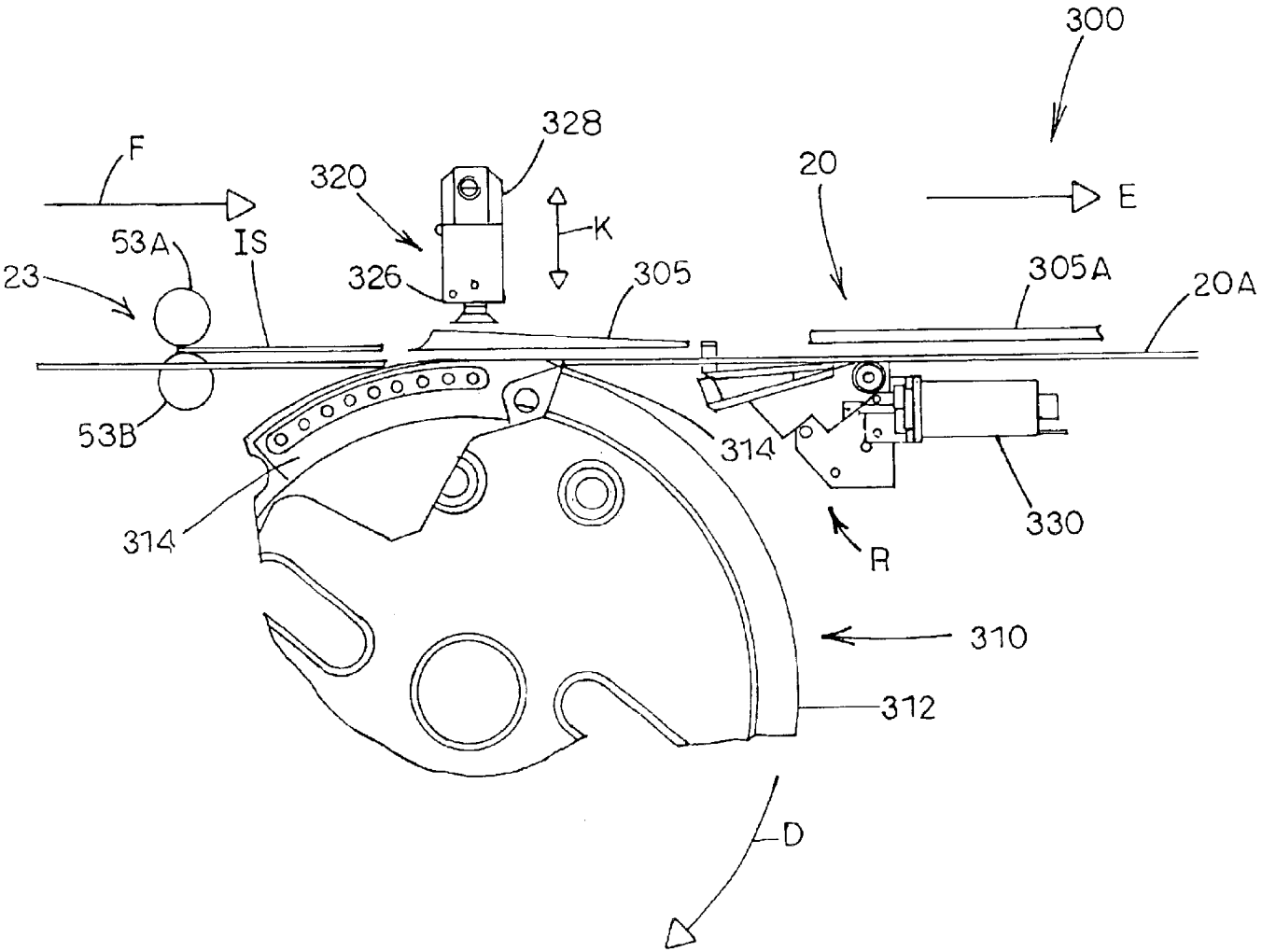
FIG. 10 is a partially cutaway side elevation view of a document handling apparatus provided in the form of an envelope insertion apparatus.

Referring now to FIG. 10, document handling apparatus 10 (FIG. 1) is provided in the form of an envelope insertion apparatus, generally designated 300, which inserts incoming sheets or other types of insertable material units into envelopes 305 for subsequent mail processing. Envelope insertion apparatus 300 typically comprises an envelope feed assembly, generally designated 310. Envelope feed assembly 310 can comprise, for example, a conventional rotating, vacuum-operated envelope drum 312 generally situated below a transport surface 20A along which an input stream of incoming sheets IS travels in feed direction F. Envelope feed assembly 310 also comprises an envelope gripping member 314 of conventional design that temporarily holds at least a portion of envelope 305 while it is being opened. A suitable motor (not shown) rotates envelope drum 312 along an envelope feed direction indicated by arrow D to sequentially feed envelopes 305 along an arcuate path to transport surface 20A. Transport surface 20A has a slot 314 through which envelopes 305 can be fed by envelope drum 312 from a position below transport surface 20A to a position at or above transport surface 20A so that envelopes 305 can be opened and stuffed with an incoming sheet IS. Slot 314 thus constitutes the insertion point of envelope insertion apparatus 300, or the merging point at which the input stream of sheets IS is combined with the input stream of envelopes 305. Envelope insertion apparatus 300 further comprises an envelope opening device, generally designated 320. Typically, envelope opening device 320 comprises a vertically movable vacuum cup 326 coupled to a suitable vacuum source (not shown). Envelope opening device 320 is driven by a solenoid 328 or other suitable actuating mechanism to reciprocate vacuum cup 326 along the direction indicated by arrow K. Another type of known envelope opening device utilizes movable fingers to open envelopes 305 instead of vacuum.

The conventional operation of envelope insertion apparatus 300 entails feeding sheets IS along feed direction F by suitable conveying means while feeding envelopes 305 along envelope feed direction D. Once an envelope 305 reaches slot 314 in transport surface 20A, envelope opening device 320 is actuated downwardly toward envelope 305 to subject envelope 305 to the vacuum created at vacuum cup 326. One portion of envelope 305 is retained by envelope gripping device 314 while another portion of envelope 305 is drawn by vacuum into contact with vacuum cup 326, thereby opening envelope 305. A registration device, generally designated R, is movable into the feed plane such as through mechanical association with a solenoid 330. Registration device R is conventionally provided to contact the lead edge of envelope 305 and thus stop and register envelope 305 while envelope 305 is being opened. Once envelope 305 has been opened, an incoming sheet IS is advanced along transport surface 20A. The stuffed envelope 305A is then transported by conventional means to an appropriate downstream module.

In accordance with the invention, dynamic infeed assembly 23 as described herein above with reference to FIG. 1 is positioned along transport surface 20A upstream of slot 314 to enhance the insertion process. Electronic controller EC (see FIG. 1) is used to coordinate the respective operations of dynamic infeed assembly 23, envelope feed assembly 310, envelope opening device 320, and registration device R. Moreover, electronic controller EC is programmed to control dynamic infeed assembly 23 according to a dynamic speed profile that has a period of acceleration. Thus, incoming sheets IS fed to dynamic infeed assembly 23 are accelerated thereby so as to "overtake" the flow of envelopes 305 to the insertion point at slot 314. As a result, each incoming sheet IS is accelerated, and thus inserted, into a corresponding opened envelope 305. By this configuration, the insertion process can be made essentially continuous such that the frequency of insertions are greater in comparison to conventional processes. That is, the feeding of incoming sheets IS along sheet feed direction F and the feeding of envelopes 305 along envelope feed direction D do not need to be stopped between the insertion cycles. Registration device R is used, if at all, only to momentarily square an envelope 305 for the purpose of maintaining proper alignment of envelope 305 as it is being opened by envelope opening device 320.

It can also be seen that the use of dynamic infeed assembly 23 is advantageous in applications, such as the present embodiment, in which the movement rate of one or more components (e.g., actuated components such as envelope opening device 320) is constant and cannot be altered, while the movement rate of other components (e.g., the means used for transporting incoming sheets IS and envelopes 305) is adjustable. That is, different processing jobs that require different parameters (e.g., the respective sizes of incoming sheets IS and/or envelopes 305) often likewise require different overall process cycle speeds (i.e., master cycle speeds). At the same time, however, each movable component must be maintained in synchronization with the other movable components at any given master cycle speed. When the master cycle speed is to be either increased or decreased, adjustment of variable-speed components such as envelope feed assembly 310 can result in either a lag or lead time associated with the operation of a non-adjustable component such as envelope opening device 320, which in turn can result in an operational error such as envelope insertion failure. Dynamic infeed device 23, operating according to a dynamic speed profile characterized by either acceleration or deceleration as appropriate, can be used to maintain synchronization by rectifying the lead or lag time associated with the non-adjustable component.

It will be understood that various details of the invention may be changed without departing from the scope of the invention. Furthermore, the foregoing description is for the purpose of illustration only, and not for the purpose of limitation—the invention being defined by the claims.

What is claimed is:

1. A document handling apparatus for processing sheets, comprising:

(a) a dynamic in-feed device for inputting a sheet according to a repeatable dynamic speed profile, the dynamic speed profile being defined by an initial input speed, a subsequent varying speed curve, and a final input speed, the dynamic in-feed device comprising a sheet-driving device and a variable-speed motor operatively engaging the sheet-driving device;

(b) a sheet receiving section disposed downstream from the dynamic in-feed device;

(c) an electronic controller communicating with the variable-speed motor for controlling a speed of the dynamic in-feed device according to the dynamic speed profile; and (d) an initializing device communicating with the electronic controller and adapted to produce a signal to begin the dynamic speed profile, the initializing device comprising a sheet-sensing device adapted to detect entry of a sheet into the sheet receiving section.

2. The apparatus according to claim 1 wherein the varying speed curve includes a decelerating speed curve, and the final input speed is less than the initial input speed.

3. The apparatus according to claim 1 wherein the varying speed curve includes an accelerating speed curve, and the final input speed is greater than the initial input speed.

4. The apparatus according to claim 1 wherein the sheet-driving device comprises at least a pair of input rollers, and at least one of the input rollers is driven by the variable-speed motor.

5. The apparatus according to claim 1 wherein the sheet receiving section is defined by a plurality of generally parallel guide rods.

6. The apparatus according to claim 1 comprising a front stop mechanism disposed downstream from the dynamic in-feed device and electronically communicating with the electronic controller.

7. The apparatus according to claim 6 wherein the dynamic in-feed device defines a sheet feed plane extending into the sheet receiving section, and the front stop mechanism is movable into and out of the sheet feed plane.

8. The apparatus according to claim 7 wherein the front stop mechanism comprises a front stop member and an actuator connected thereto, wherein the electronic controller communicates with the actuator.

9. A document handling apparatus comprising:

(a) a sheet input device comprising a first input roller and an opposing second input roller, wherein a nip is formed between the first and second input rollers and a sheet feed plane is defined between the first and second input rollers at least generally through the nip;

(b) a sheet receiving surface disposed downstream from the sheet input device at least generally along the sheet feed plane;

(c) a front stop mechanism disposed downstream from the sheet input device, the front stop mechanism comprising a front stop member and an actuator connected to the front stop member, wherein the front stop member is movable by the actuator into and out of the sheet feed plane; and (d) an electronic controller communicating with the sheet input device for operating the sheet input device according to a repeatable dynamic speed profile defined by an initial input speed, a subsequent varying speed curve, and a final input speed.

10. The apparatus according to claim 9 wherein the varying speed curve includes a decelerating speed curve, and the final input speed is less than the initial input speed.

11. The apparatus according to claim 9 wherein the varying speed curve includes an accelerating speed curve, and the final input speed is greater than the initial input speed.

12. The apparatus according to claim 9 wherein the sheet receiving surface is defined by a plurality of generally parallel guide rods.

13. The apparatus according to claim 9 comprising an initializing device communicating with the electronic controller and adapted to produce a signal to begin the dynamic speed profile.

14. The apparatus according to claim 13 wherein the initializing device comprises a sheet-sensing device adapted to detect entry of a sheet into the sheet receiving section.

15. The apparatus according to claim 9 wherein the front stop mechanism electronically communicates with the electronic controller.

16. The apparatus according to claim 15 wherein the front stop mechanism is movable into and out of the sheet feed plane.

17. The apparatus according to claim 16 wherein the front stop mechanism comprises a front stop member and an actuator connected thereto, wherein the electronic controller communicates with the actuator.

18. A method for inputting sheets into a sheet handling apparatus, comprising the steps of:

(a) feeding a sheet at an initial input speed to a dynamic in-feed device, the dynamic in-feed device comprising a sheet-driving device and a variable-speed motor operatively engaging the sheet-driving device;

(b) controlling an operational speed of the sheet-driving device by controlling an operational speed of the variable-speed motor according to a repeatable dynamic speed profile, the dynamic speed profile being defined by the initial input speed, a subsequent varying speed curve, and a final input speed;

(c) using the sheet-driving device to engage the sheet and drive the sheet into a sheet receiving section of the sheet handling apparatus according to the dynamic speed profile, whereby the sheet is driven at the initial input speed, and the initial input speed is changed according to the varying speed curve until the final input speed is reached and the sheet has reached a final position in the sheet receiving section;

(d) detecting the presence of the sheet in the final position; and (e) upon detection of the sheet in the final position, inputting a new sheet by repeating steps (a)–(d) for the new sheet.

19. The method according to claim 18 wherein the varying speed curve is a decelerating speed curve, and the final input speed is less than the initial input speed.

20. The method according to claim 18 wherein the varying speed curve is an accelerating speed curve, and the final input speed is greater than the initial input speed.

21. The method according to claim 18 wherein the step of controlling the operational speed of the variable-speed motor comprises transmitting an electronic signal to the motor from an electronic controller adapted to execute instructions establishing the dynamic speed profile.

22. The method according to claim 21 wherein the step of detecting the presence of the sheet in the final position comprises using an electronic sensing device, and the step of controlling the operational speed of the variable-speed motor comprises sending a detection signal to the electronic controller from the electronic sensing device.

23. The method according to claim 18 wherein the step of detecting the presence of the sheet in the final position comprises using an electronic sensing device.

24. The method according to claim 18 comprising the step of stopping the sheet at the final position by moving a front stop mechanism into the path of the sheet in the sheet receiving section.

25. The method according to claim 24 comprising the steps of counting each sheet inputted into the sheet receiving section and reaching the final position therein and, after a designated number of sheets have reached the final position, moving the front stop mechanism out from the path of the sheets to enable the sheets to be transported from the sheet handling apparatus to a downstream location.

26. A method for inputting a sheet into a document handling apparatus, comprising the steps of:

(a) receiving a leading edge of the sheet at an initial speed;

(b) initially feeding the sheet, including its leading edge, into the document handling apparatus at a first input speed substantially equal to the initial speed;

(c) continuing to feed the sheet, including a portion of the sheet following the leading edge, into the document handling apparatus according to a varying speed curve;

(d) completing the feeding of the sheet, including a trailing edge of the sheet, into the document handling apparatus at a final input speed;

(e) detecting the presence of the sheet in a final position; and (f) upon detection of the sheet in the final position, receiving a new sheet and repeating at least steps (b)–(d) for the new sheet.

27. The method according to claim 26 wherein the varying speed curve is a decelerating speed curve, and the final input speed is less than the first input speed.

28. The method according to claim 26 wherein the varying speed curve is an accelerating speed curve, and the final input speed is greater than the first input speed.

29. The method according to claim 26 wherein feeding the sheet according to the varying speed curve comprises operating a variable-speed motor.

30. The method according to claim 29 comprising controlling the variable-speed motor by transmitting an electrical signal to the motor from an electronic controller adapted to execute instructions for implementing the varying speed curve.

31. The method according to claim 26 comprising stopping a sheet at the final position by moving a front stop mechanism into a path along which sheets are fed.

32. A document handling apparatus for processing sheets, comprising:

(a) a dynamic in-feed device for inputting a sheet according to a repeatable dynamic speed profile, the dynamic speed profile being defined by an initial input speed, a subsequent varying speed curve, and a final input speed, the dynamic in-feed device comprising a sheet-driving device and a variable-speed motor operatively engaging the sheet-driving device;

(b) a sheet receiving section disposed downstream from the dynamic in-feed device and comprising a plurality of generally parallel guide rods; and (c) an electronic controller communicating with the variable-speed motor for controlling a speed of the dynamic in-feed device according to the dynamic speed profile.

33. The apparatus according to claim 32 wherein the sheet driving device comprises a first input roller and a second input roller, a sheet feed plane is defined between the first and second input rollers, and the sheet receiving section is disposed generally along the sheet feed plane.

34. The apparatus according to claim 32 comprising a front step mechanism disposed downstream from the dynamic in-feed device.

35. The apparatus according to claim 32 comprising an initializing device communicating with the electronic controller and adapted to produce a signal to begin the dynamic speed profile.

36. The apparatus according to claim 35 wherein the initializing device comprises a sheet-sensing device adapted to detect entry of a sheet into the sheet receiving section.

37. A document handling apparatus comprising:

(a) a sheet input device comprising a first input roller and a second input roller, wherein a sheet feed plane is defined between the first and second input rollers;

(b) a sheet receiving surface disposed downstream from the sheet input device;

(c) a front stop mechanism disposed downstream from the sheet input device, the front stop mechanism comprising a front stop member and an actuator connected to the front stop member, wherein the front stop member is movable by the actuator into and out of the sheet feed plane; and (d) an electronic controller communicating with the sheet input device for operating the sheet input device according to a repeatable dynamic speed profile defined by an initial input speed, a subsequent varying speed curve comprising an accelerating speed curve, and a final input speed greater than the initial input speed.

38. The apparatus according to claim 37 wherein the sheet receiving surface is defined by a plurality of generally parallel guide rods.

39. The apparatus according to claim 37 comprising a sheet-sensing device communicating with the electronic controller for producing a signal to begin the dynamic speed profile.

40. A document handling apparatus comprising:

(a) a sheet input device comprising a first input roller and a second input roller, wherein a sheet feed plane is defined between the first and second input rollers;

(b) a sheet receiving surface disposed downstream from the sheet input device and comprising a plurality of generally parallel guide rods;

(c) a front stop mechanism disposed downstream from the sheet input device, the front step mechanism comprising a front stop member and an actuator connected to the front stop member, wherein the front stop member is movable by the actuator into and out of the sheet feed plane; and (d) an electronic controller communicating with the sheet input device for operating the sheet input device according to a repeatable dynamic speed profile defined by an initial input speed, a subsequent varying speed curve, and a final input speed.

41. The apparatus according to claim 40 comprising a sheet-sensing device communicating with the electronic controller for producing a signal to begin the dynamic speed profile.

42. A document handling apparatus comprising:

(a) a sheet input device comprising a first input roller and a second input roller, wherein a sheet feed plane is defined between the first and second input rollers;

(b) a sheet receiving surface disposed downstream from the sheet input device generally along the sheet feed plane;

(c) a front stop mechanism disposed downstream from the sheet input device, the front stop mechanism comprising a front stop member and an actuator connected to the front stop member, wherein the front stop member is movable by the actuator into and out of the sheet feed plane; and (d) an electronic controller communicating with the sheet input device for operating the sheet input device according to a repeatable dynamic speed profile defined by an initial input speed, a subsequent varying speed curve, and a final input speed, and wherein the varying speed curve includes an accelerating speed curve, and the final input speed is greater than the initial input speed.

43. A document handling apparatus comprising:

(a) a sheet input device comprising a first input roller and a second input roller, wherein a sheet feed plane is defined between the first and second input rollers;

(b) a sheet receiving surface disposed downstream from the sheet input device generally along the sheet feed plane, wherein the sheet receiving surface is defined by a plurality of generally parallel guide rods;

(c) a front stop mechanism disposed downstream from the sheet input device, the front stop mechanism comprising a front stop member and an actuator connected to the front stop member, wherein the front stop member is movable by the actuator into and out of the sheet feed plane; and (d) an electronic controller communicating with the sheet input device for operating the sheet input device according to a repeatable dynamic speed profile defined by an initial input speed, a subsequent varying speed curve, and a final input speed.

* * * * *